US006467107B1

(12) United States Patent
Glover et al.

(10) Patent No.: US 6,467,107 B1
(45) Date of Patent: Oct. 22, 2002

(54) PLAYYARD CANOPY FRAME RETAINER

(75) Inventors: Richard Glover, Greenwood, IN (US); Jerome J. Drobinski, Reading, PA (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/692,887

(22) Filed: Oct. 20, 2000

Related U.S. Application Data

(60) Provisional application No. 60/234,545, filed on Sep. 22, 2000, and provisional application No. 60/160,652, filed on Oct. 21, 1999.

(51) Int. Cl.[7] ..... A47D 7/00; A47D 13/06; A47C 29/00

(52) U.S. Cl. ..... 5/99.1; 5/93.1; 5/97; 135/125

(58) Field of Search ..... 5/99.1, 93.1, 97, 5/98.1, 414, 416; 135/124, 125, 128, 136, 138

(56) References Cited

U.S. PATENT DOCUMENTS

| | | | | | |
|---|---|---|---|---|---|
| 1,021,930 | A | * | 4/1912 | Jackson | 135/121 |
| 1,264,078 | A | * | 4/1918 | Jaureguy | 135/126 |
| 2,681,659 | A | | 6/1954 | Hrinsin | 256/25 |
| 2,820,468 | A | * | 1/1958 | Park et al. | 5/97 X |
| 2,958,084 | A | | 11/1960 | Kenney | 5/99.1 |
| 4,043,349 | A | * | 8/1977 | Gays et al. | 135/137 |
| 4,790,340 | A | | 12/1988 | Mahoney | 135/90 |
| 4,811,437 | A | | 3/1989 | Dillner et al. | 5/99.1 |
| 4,945,584 | A | * | 8/1990 | LaMantia | 5/97 |
| 5,099,866 | A | | 3/1992 | Solis et al. | 135/154 |
| 5,279,006 | A | | 1/1994 | Teng | 5/99.1 |
| D366,978 | S | | 2/1996 | Mariol | D6/491 |
| D367,788 | S | | 3/1996 | Lawhorn | D6/491 |
| D370,149 | S | | 5/1996 | Stratton | D6/610 |
| 5,517,707 | A | * | 5/1996 | LaMantia | 5/97 |
| 5,553,336 | A | * | 9/1996 | Mariol | 5/93.1 |
| 5,615,427 | A | * | 4/1997 | Huang | 5/99.1 |
| D390,730 | S | | 2/1998 | Gerhart et al. | D6/491 |
| D404,216 | S | | 1/1999 | Gerhart | D6/391 |
| 5,862,548 | A | | 1/1999 | Gerhart | 5/93.1 |
| 5,991,944 | A | * | 11/1999 | Yang | 5/99.1 |
| 6,109,280 | A | * | 8/2000 | Custer | 135/116 |
| 6,123,091 | A | | 9/2000 | Flynn et al. | 135/96 |
| 6,131,218 | A | * | 10/2000 | Wang | 5/99.1 X |
| 6,192,535 | B1 | * | 2/2001 | Warner, Jr. et al. | 5/99.1 X |
| 6,233,759 | B1 | * | 5/2001 | Warner, Jr. et al. | 5/99.1 |
| 6,357,462 | B1 | * | 3/2002 | Laosunthara et al. | 135/138 X |
| 2001/0001330 | A1 | * | 5/2001 | Warner, Jr. et al. | 5/99.1 |

OTHER PUBLICATIONS

Evenflo brochure, "Celebrating Seventy–Five Years", three pages, 1995.

* cited by examiner

*Primary Examiner*—Robert G. Santos
(74) *Attorney, Agent, or Firm*—Barnes & Thornburg

(57) ABSTRACT

A playyard includes a retainer carried on a canopy frame support rod. The retainer is configured to be coupled to a retainer mount carried on a playyard frame so that a canopy cover attached to the canopy frame support rod is retained in place on the playground.

21 Claims, 12 Drawing Sheets

FIG. 7
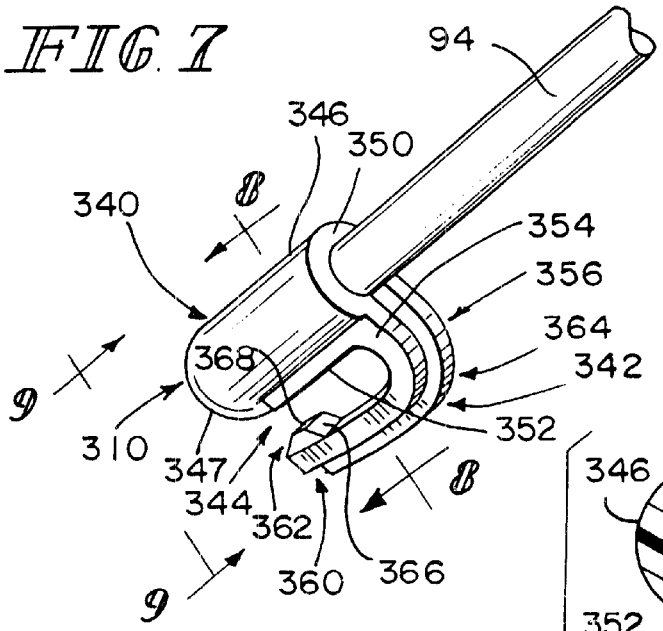
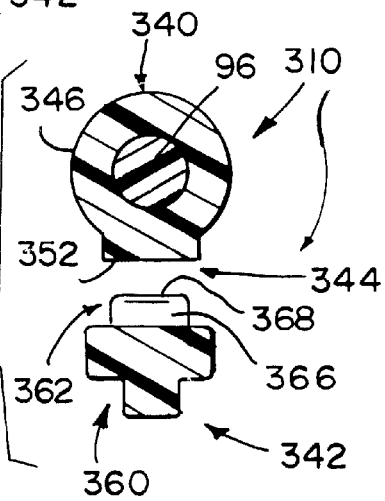
FIG. 8
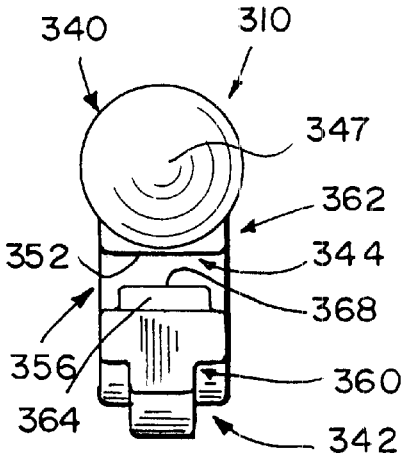
FIG. 9

96
82
96
80
152
152
91
127
97
131
132
92
86
89
90
128
148
95
142
95
88
20
20
26
68
66
74
76
30
18
14
78
32
42
36
46
44
22
22

PLAYYARD CANOPY FRAME RETAINER

This application claims priority under 35 U.S.C. 119(e) to U.S. Provisional Application Ser. No. 60/234,545, filed Sep. 22, 2000 and Provisional Application Ser. No. 60/160,652, filed Oct. 21, 1999, which are expressly incorporated by reference herein.

BACKGROUND AND SUMMARY OF THE INVENTION

The present invention relates to playyards in which small children can be placed, and particularly to a system for mounting a playyard canopy to the top of a playyard frame to cover the playyard. More particularly, the present invention relates to a corner support associated with a playyard, the corner support receiving and supporting a canopy support rod.

Playyards in which small children can be placed are well known. Playyards are typically configured as cubicles having a floor panel and side panels extending upwardly therefrom to confine the child within the playyard so that the child is prevented from wandering away from the playyard. Some conventional playyards are collapsible allowing the playyard to be folded from an opened playyard configuration to a collapsed compact storage configuration. See, for example, U.S. Pat. Nos. 5,279,006 to Teng and U.S. Pat. No. 4,811,437 to Dillner et al.

Playyards usually have open tops so that a person attending to the child can place the child into and remove the child from the playyard easily. In addition, the side panels of conventional playyards are usually somewhat transparent so that the person attending to the child can see into the playyard to observe the activities of the child and so that the child can see out of the playyard to observe the surrounding environment. When a playyard is exposed to direct sunlight, the open top permits the sunlight to shine into the playyard potentially making the child contained in the playyard uncomfortable. The open top of the playyard also permits other objects to enter the playyard.

Playyard covers that can be attached to the playyard to cover the open top of the playyard are known. See, for example, U.S. application Ser. No. 08/940,909, filed Sep. 30, 1997 and U.S. Pat. Nos. 2,681,659; 4,790,340; 5,862,548; 5,099,866; 2,958,084; U.S. Pat. No. Des. 370,149; U.S. Pat. No. Des. 404,216; U.S. Pat. No. Des. 390,730; U.S. Pat. No. Des. 367,788; and U.S. Pat. No. Des. 366,978 and the HAPPY CABANA™ Play Yard disclosed in the Evenflo 1995 Baby Products Catalog at page 12, which disclosures are hereby incorporated by reference herein.

A playyard in accordance with the present invention includes a retainer carried on a canopy frame support rod and configured to be coupled to a retainer mount carried on a playyard frame so that a canopy cover attached to the canopy frame support rod is retained in place on the playyard. In preferred embodiments, the retainer mount is included in a playyard frame corner piece and sloped from a low point in an interior corner of the corner piece to a high point along a leading edge of the retainer mount. The retainer includes a retainer tip formed to include a bore receiving an outer end of the canopy frame support rod snugly therein and a resilient retainer clasp coupled to the underside of the cylindrical body to form a channel therebetween sized to receive and grip a portion of the retainer mount therein to "anchor" the retainer to the retainer mount.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 7 is a perspective view of the interconnected retainer and canopy frame support rod of FIG. 5 prior to attachment of the retainer to the playyard frame corner piece;

FIG. 8 is a sectional view taken along line 8—8 of FIG. 7 of portions of the retainer and canopy frame support rod;

FIG. 9 is a front elevation view taken along line 9—9 of FIG. 7 of the retainer;

DETAILED DESCRIPTION OF THE DRAWINGS

Figure 1:
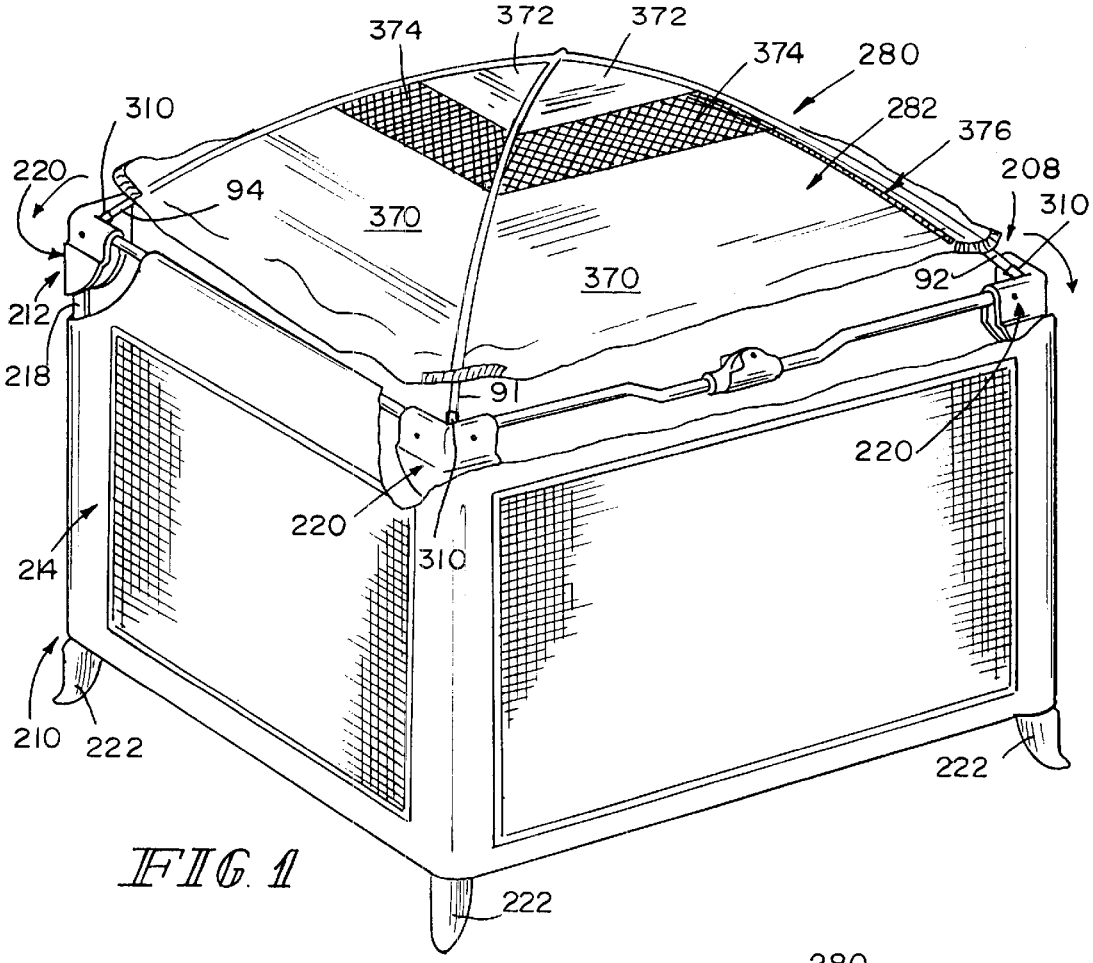
FIG. 1 is a perspective view of a playyard canopy retained on a playyard in accordance with the present invention and showing support rods included in a canopy frame coupled to corner pieces included in a playyard frame.
Figure 2:
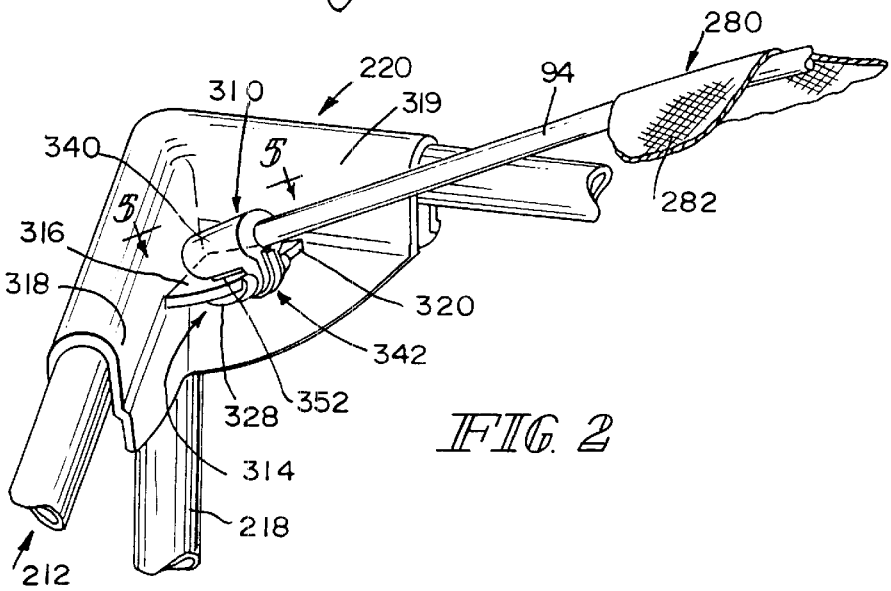
FIG. 2 is an enlarged perspective view of the rear corner piece included in the left side of the playyard frame of FIG. 1 and showing a retainer fixed on an outer end of one of the canopy frame support rods coupled to a sloped retainer mount included in that left-side rear corner piece to "anchor" the canopy frame support rod to the playyard frame corner piece.

Playyard 210 includes a collapsible frame 212, a fabric frame cover 214, and a collapsible playyard canopy 280 configured to cover the top of playyard 210 as shown in FIG. 1. Playyard canopy 280 includes a canopy frame 208 (see FIGS. 20–23) and a canopy cover 282 supported on the canopy frame. Canopy 280 is retained in place on playyard 210 as shown, for example, in FIG. 1. A retainer 310 fixed on an outer end of each of the support rods 91, 92, 93, and 94 included in the canopy frame 208 is configured to be coupled to a retainer mount 314 fixed on a corner piece 220 included in collapsible frame 212 as shown, for example, in FIGS. 1, 2, and 5. Retainer 310 is configured to be attached to and detached from retainer mount 314 easily by a caregiver as that caregiver "sets up" playyard 210 for use or "takes down" playyard 210 for transit or storage.

Figure 11:
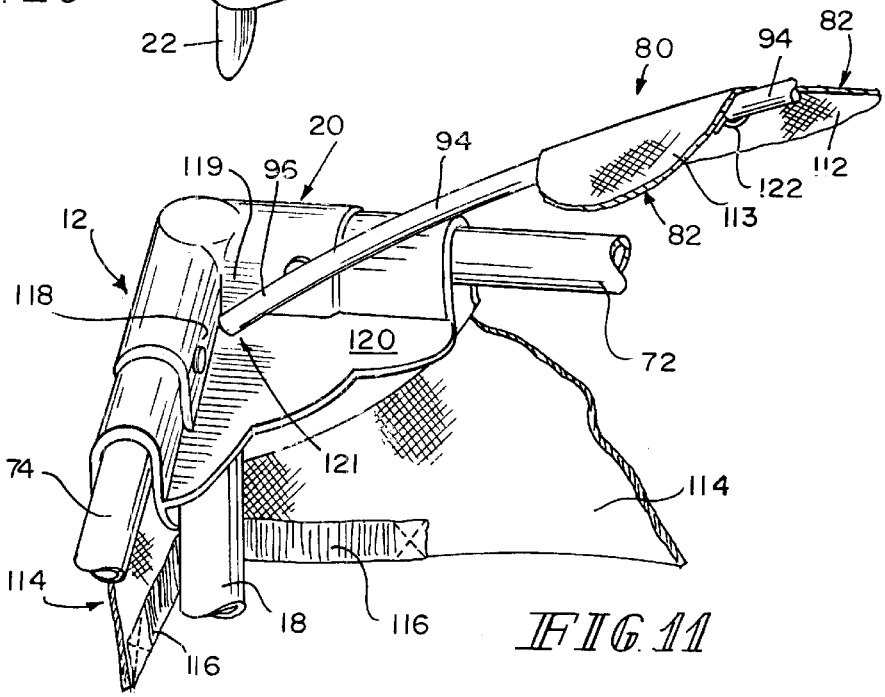
FIG. 11 is an enlarged perspective view of a portion of the left rear corner of the playyard of FIG. 10 showing engagement of an outer end of a canopy support rod with one of the corners of the playyard and showing the position of one of the elastic bands relative to the playyard frame when the canopy is mounted on the playyard.
Figure 18:
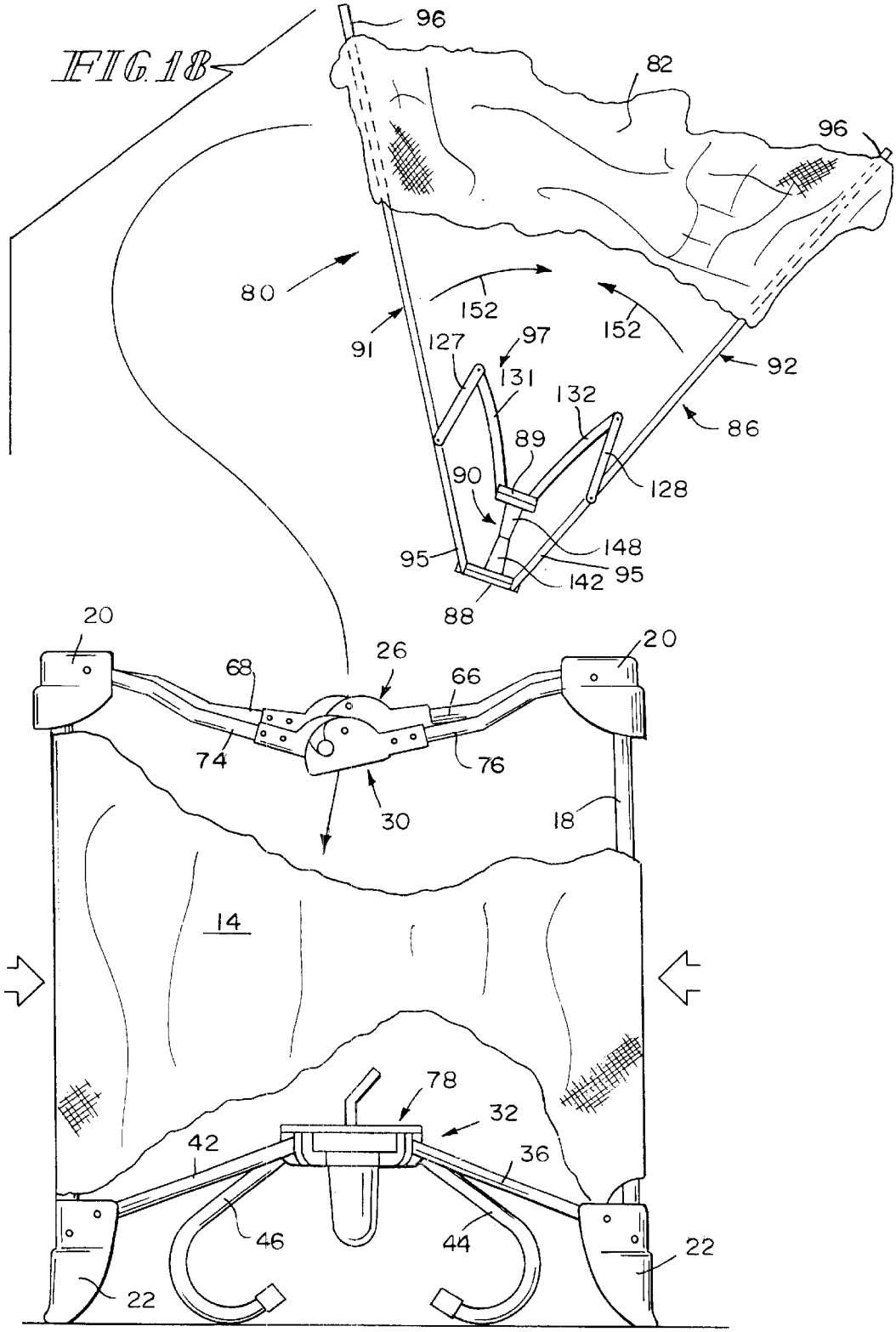
FIG. 18 is an end elevation view of the playyard of FIGS. 10 and 12 as it is being collapsed showing partial collapse of the playyard canopy after it has been removed from the mounted position shown in FIG. 10 and before it is placed in the storage position shown in FIG. 19.
Figure 23:
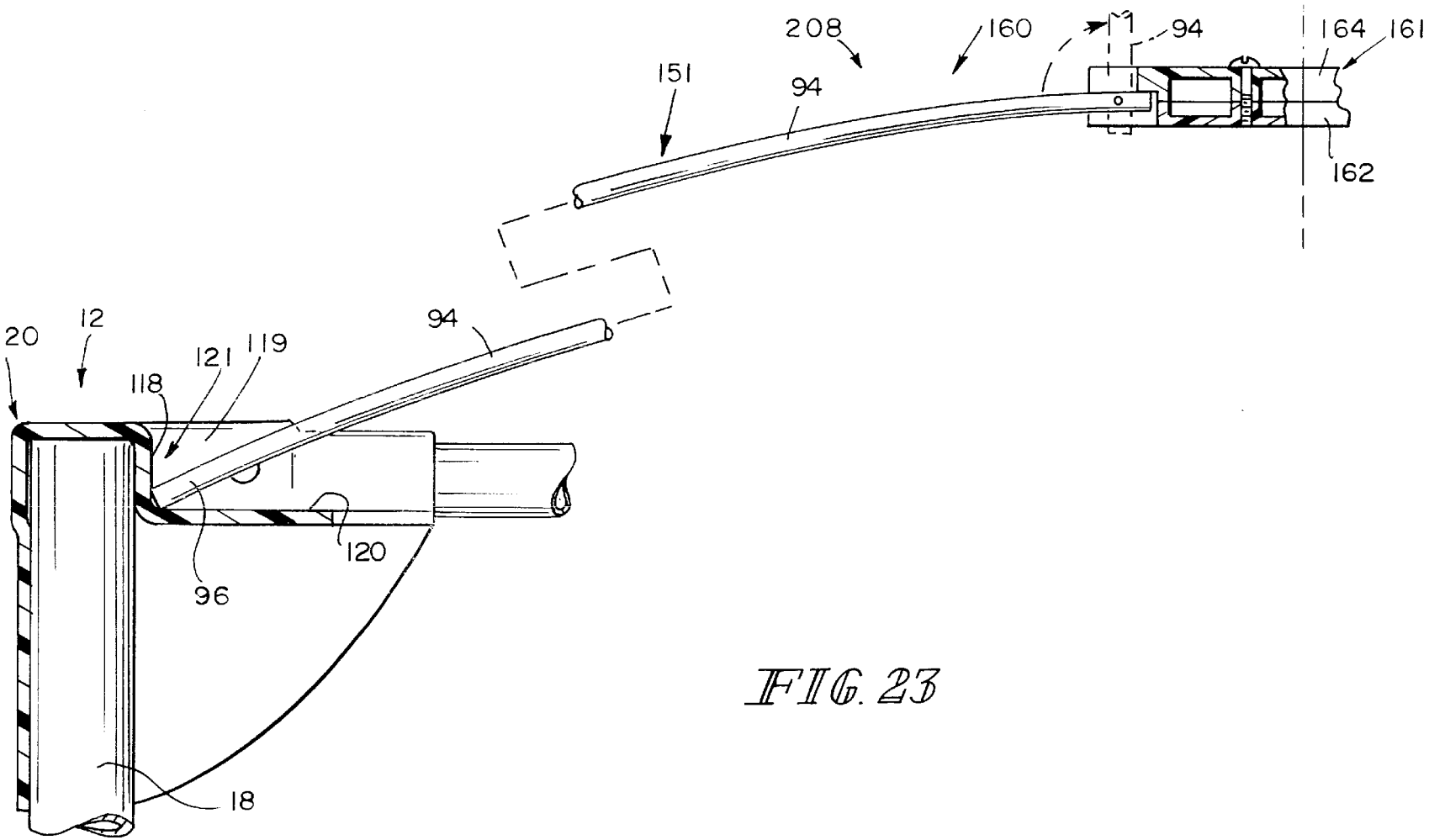
FIG. 23 is a view similar to FIG. 17 of the canopy support of FIG. 20 engaged to a playyard corner piece included in the playyard of FIGS. 10 and 12.

Another system for retaining a canopy frame in a fixed position on a playyard is disclosed, for example, in FIGS. 11, 18, and 23. In such a system, corner piece 20 includes upright walls 118 and 119 and a rod base 120 coupled to upright walls 118, 119 to form an interior corner 112 adapted to receive one of the outer ends 96 of a canopy support rod 91–94 when a canopy 80 is mounted on a playyard 10.

Returning now to the embodiment of FIGS. 1–9, it will be seen that collapsible frame 212 includes four corner legs 218, a corner piece 220 at the top end of each corner leg 218, and a corner foot 222 at the bottom end of each corner leg 218. Frame 212 also includes a foldable top rail interconnecting each pair of adjacent corner pieces and various support rails coupled to the corner feet (see FIG. 12 for illustrative top and support rails).

Figure 3:
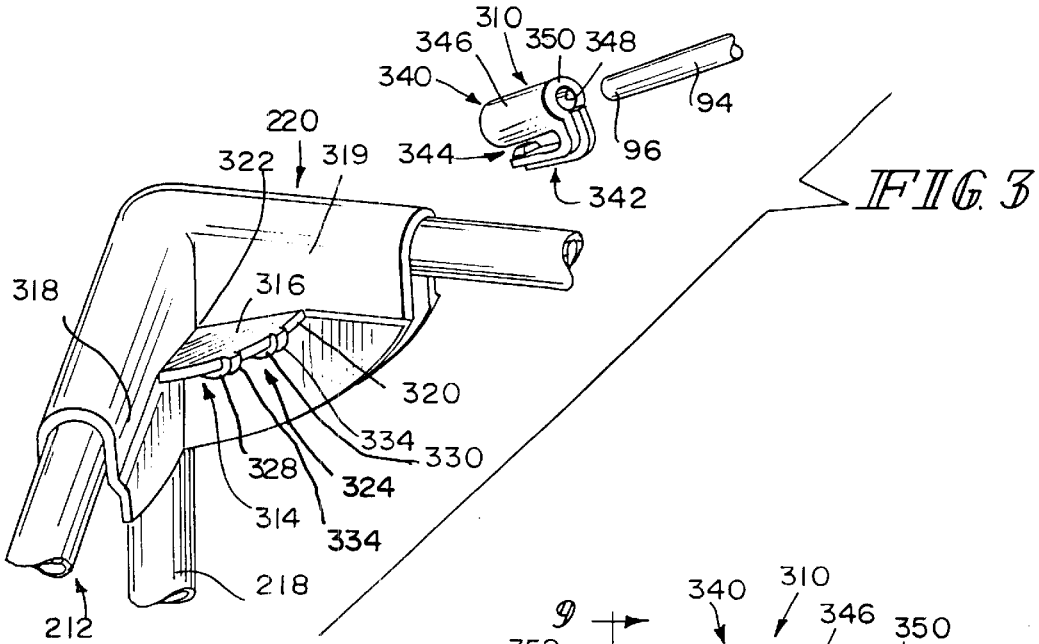
FIG. 3 is an exploded perspective view of the components illustrated in FIG. 2 showing the sloped retainer mount, a pair of retainer guides appended to the underside of the sloped retainer mount, the retainer, and the outer end of the canopy frame support rod that is sized to fit snugly in a bore formed in the retainer.
Figure 4:
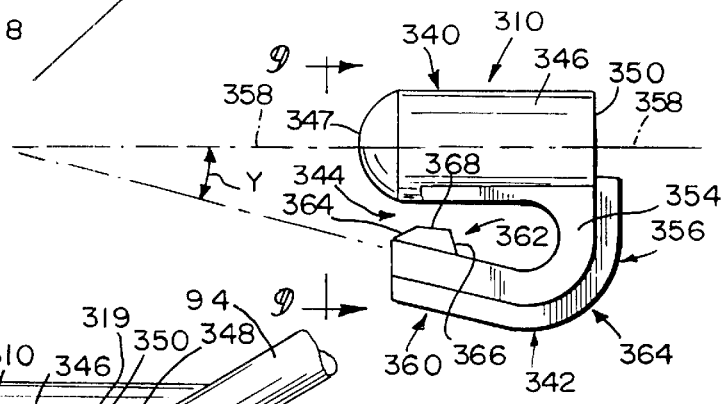
FIG. 4 is an enlarged, side elevation view of the retainer illustrated in FIGS. 1–3 showing a rod tip configured to fit onto the outer end of a canopy frame support rod (as shown in FIGS. 2 and 5) and a clasp coupled to the underside of the rod tip and configured to engage the underside of the sloped retainer mount (as also shown in FIGS. 2 and 5)
Figure 6:
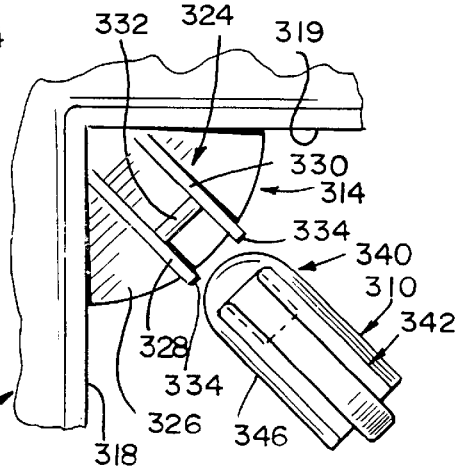
FIG. 6 is a bottom view of the retainer and retainer mount taken along line 6—6 of FIG. 5 (but before the retainer is coupled to the retainer mount) and showing a retainer positioner on the underside of the retainer mount, which positioner includes the pair of spaced-apart retainer guides and a retainer lock bar arranged to extend between the two retainer guides.

As shown best in FIGS. 3, 4, and 6, corner piece 220 includes upright walls 318 and 319 and retainer mount 314 is coupled to upright walls 318, 319 to provide a leading edge 320 extending between upright wall 318 and upright wall 319. Retainer mount 314 is oriented to lie at an angle with respect to a horizontal reference plane above retainer mount 314 so that a top surface 316 of retainer mount 314 slopes downwardly from a high point along leading edge 320 to a low point at an apex 322 of retainer mount 314. In a preferred embodiment, corner piece 220 is molded of a plastics material so that retainer mount 314 is integral with upright walls 318 and 319.

Figure 5:
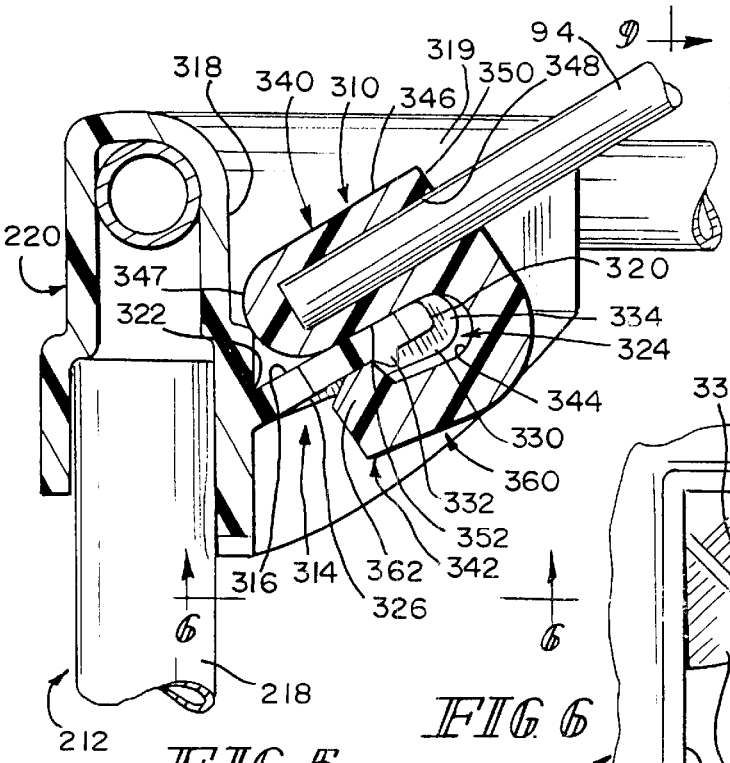
FIG. 5 is an enlarged sectional view taken along line 5—5 of FIG. 2 showing the retainer coupled to the sloped retainer mount to "anchor" the outer end of the canopy frame support rod to the playyard frame corner piece to help retain the playyard canopy in a mounted position on the underlying playyard as shown in FIG. 1.

As also shown best in FIGS. 3, 5, and 6, a positioner 324 is provided on a bottom surface 326 of retainer mount 314. In the illustrated embodiment, positioner 324 includes first and second retainer guides 328, 330 arranged to lie in spaced-apart parallel relation to one another and a transverse retainer lock bar 332 arranged to extend between retainer guides 328, 330 as shown, for example, in FIG. 6. Each retainer guide 328, 330 includes a projection 334 that extends outwardly away from and in front of leading edge 320 of retainer mount 314 as shown, for example, in FIGS. 3, 4, and 6.

Retainer 310 includes a retainer tip 340 and a clasp 342 that is coupled to an underside portion of retainer tip 340 to form a channel 344 therebetween. Retainer tip 340 is configured to be mounted on an outer end 96 of a canopy frame support rod 94. Clasp 342 and retainer tip 340 cooperate to grip retainer mount 314 when retainer 310 is arranged to place a leading portion of retainer mount 314 in channel 344 as shown, for example, in FIG. 5.

Retainer tip 340 has a cylindrical body 346 and a rounded nose 347 as shown, for example, in FIGS. 3–7. Cylindrical body 346 is formed to include a bore 348 having an opening in a rear end 350 of body 346. Bore 348 is sized to receive outer end 96 of canopy frame support member 94 snugly therein. Retainer tip 340 also includes a grip pad 352 appended to the underside of cylindrical body 346 as shown best in FIGS. 4 and 7–9 and shaped to bear against top surface 316 of retainer mount 314 when retainer 310 is coupled to retainer mount 314 as shown, for example, in FIGS. 2 and 5.

Retainer clasp 342 includes a shoulder 354 coupled to an underside portion of cylindrical body 346 at rear end 350 and an upper arm 356 depending from shoulder 354 and extending radially outwardly from a central axis 358 extending along the length of cylindrical body 346 as shown, for example, in FIGS. 4, 5, and 7. Retainer clasp 342 also includes a lower arm 360 arranged to lie at an acute angle Y to central axis 358 and a curved elbow 364 arranged to interconnect upper and lower arms 356, 360 and support lower arm 360 for movement relative to cylindrical body 346 during attachment of retainer 310 to retainer mount 314 and detachment of retainer 310 from retainer mount 314. Retainer clasp 342 is made of a resilient material and is cantilevered to cylindrical body 346 as shown, for example, in FIGS. 4, 5, and 7.

The upper and lower arm 356, 360 and curved elbow 364 of retainer clasp 342 have a T-shaped cross-sectional shape as suggested in FIGS. 7–9. The T-shaped portion of retainer clasp 342 is defined by an upper strip that faces toward the overlying grip pad 352 on cylindrical body 340 and has a width about equal to the width of grip pad 352 and a narrower lower strip that faces away from cylindrical body 340 and acts to strengthen and rigidify the upper strip. The upper strip carries another grip pad 362 which is arranged to confront the overlying grip pad 352. The lower strip is centered on and wraps around an outer surface of the upper strip.

Retainer clasp 342 also includes a grip pad 362 appended to a top side of lower arm 360 and arranged to lie in channel 344 in spaced, opposed relation to the grip pad 352 depending from the underside of cylindrical body 346. Grip pad 362 includes a forwardly facing ramp 364, a rearwardly facing lip 366, and an upwardly facing land 368 as shown best in FIGS. 4 and 7–9.

To attach retainer 310 to retainer mount 314, one places retainer 310 adjacent to leading edge 320 of retainer mount 314 so that the grip pad 362 carried on lower arm 360 of retainer clasp 342 is positioned to slide into the space provided between the two retainer guides 328, 330 appended to the bottom surface 326 of retainer mount 314. The retainer 310 is then slid onto retainer mount 314 so that retainer mount 314 is inserted into the channel 344 provided between the underside of cylindrical body 346 and the top side of retainer clasp 342 to reach the position shown in FIGS. 2 and 5. During such sliding movement, ramp 364 will ride on retainer lock bar 332 positioned to lie on bottom surface 326 between retainer guides 328, 330, causing retainer clasp 342 first to deflect and then snap back to a "locked" position wherein rearwardly facing lip 366 of grip pad 362 engages retainer lock bar 332 to "hold" retainer 310 in place on retainer mount 314. To detach retainer 310 from retainer mount 314, retainer 310 is moved away from apex 322 of retainer mount 314 to cause grip pad 362 to cam on and override retainer lock bar 332 to release retainer 310 from retainer mount 314.

Grip pad 352 on the underside of cylindrical body 346 prevents rotational movement of retainer 310 relative to retainer mount 314. Grip pad 352 has a substantially flat surface which bears on top surface 316 of retainer mount 314 as shown, for example, in FIG. 5.

As shown in FIG. 1, canopy cover 282 includes four somewhat triangular panels coupled to canopy frame support rods 91–94. Each panel includes a trapezoidal lower section 370, a triangular upper section 372, and a trapezoidal mesh section 374. A zipper 376 is provided as shown in FIG. 1.

Figure 10:
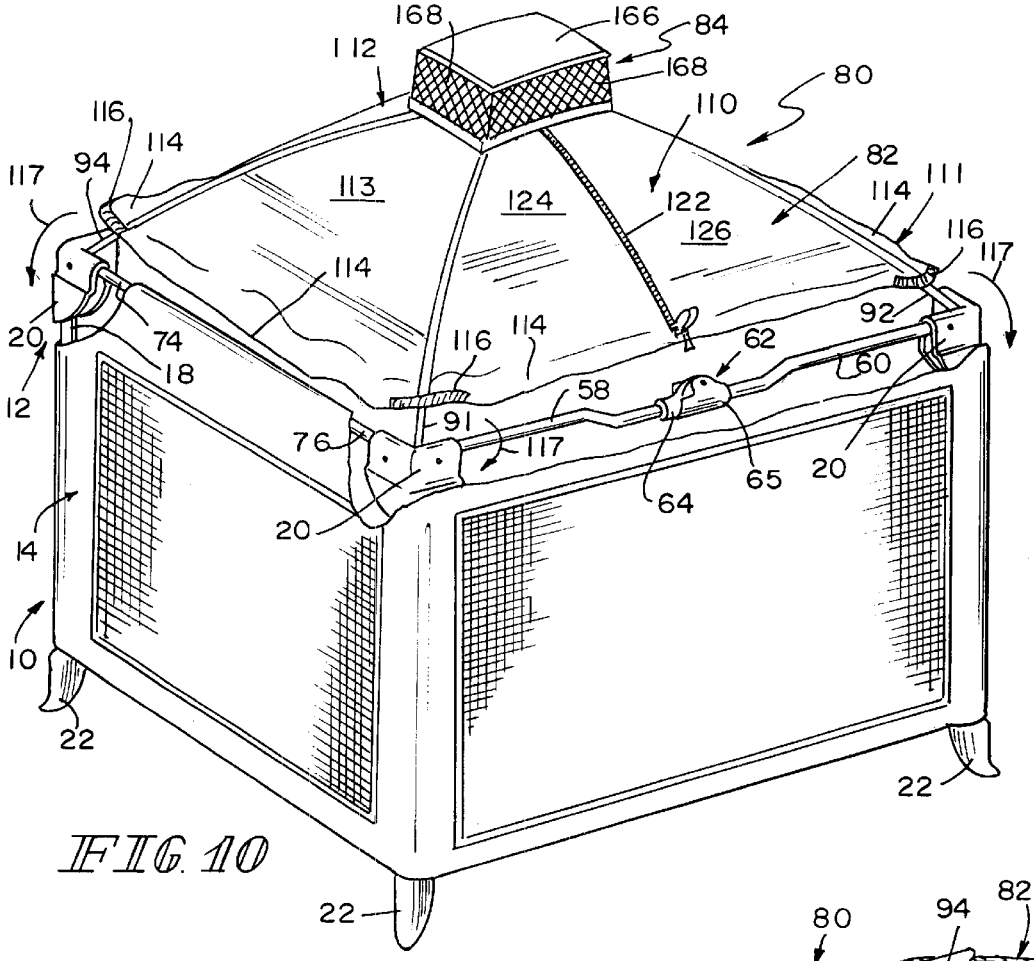
FIG. 10 is a perspective view of another embodiment of a playyard canopy showing the playyard canopy mounted on a playyard and positioned to lie above the top opening of the playyard and showing elastic bands at each corner of the fabric canopy cover before those corners and elastic bands are pulled down over corners of the underlying playyard.
Figure 12:
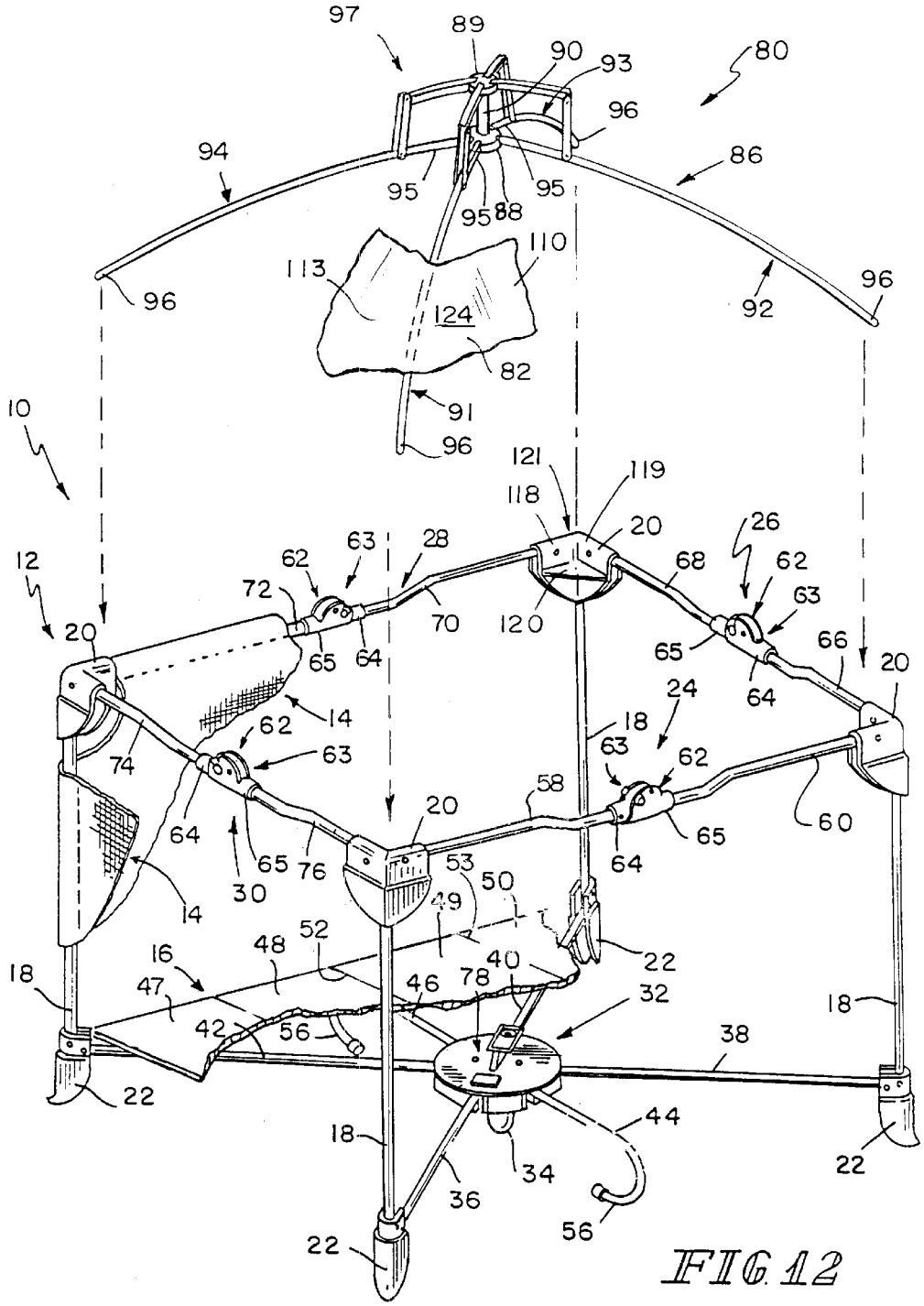
FIG. 12 is a perspective view similar to FIG. 10, with portions broken away, showing the playyard frame and floor and showing the canopy support and a small piece of the fabric canopy cover prior to installation of the canopy on the underlying playyard.
Figure 16:
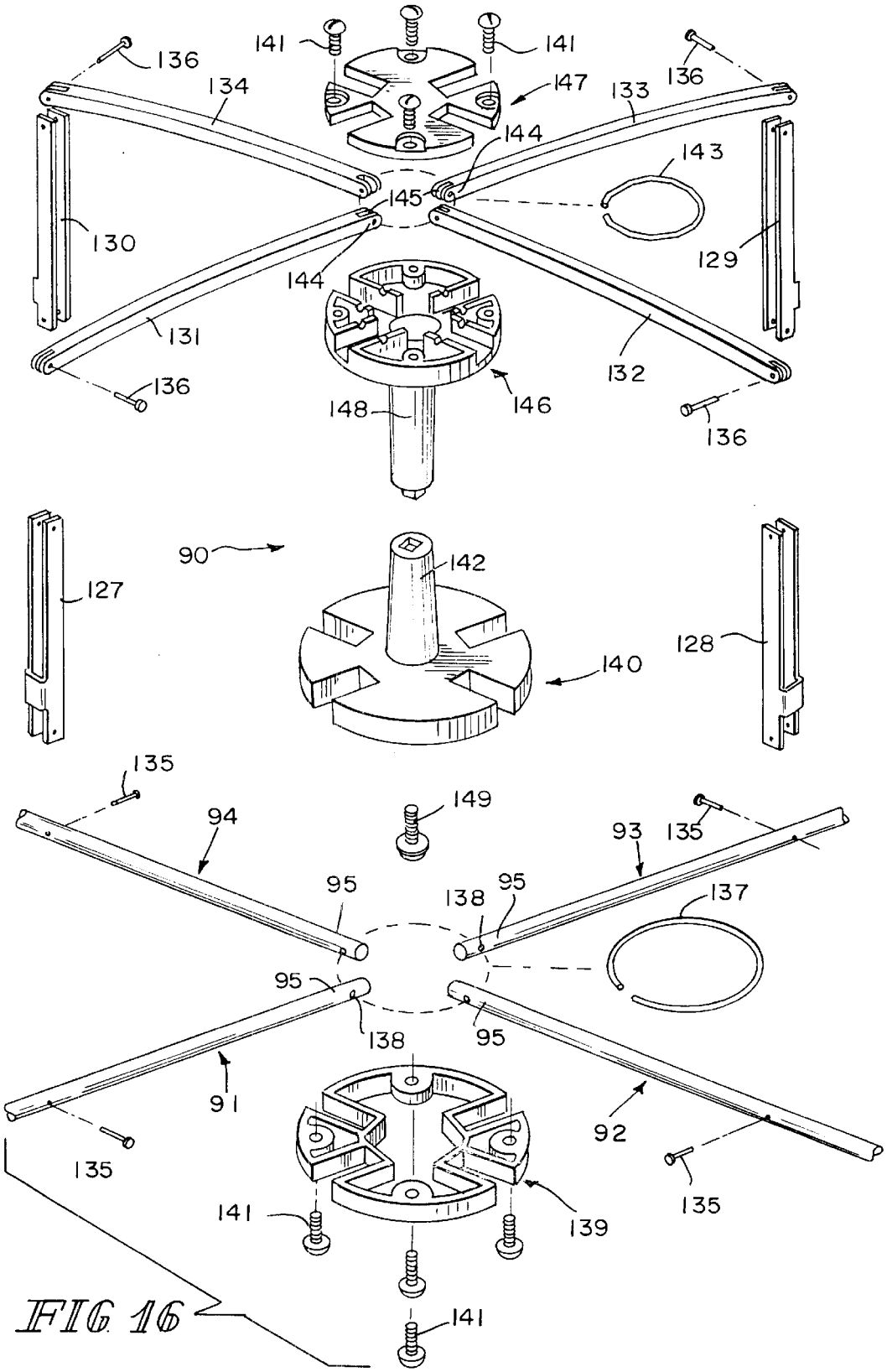
FIG. 16 is an exploded perspective view of components that can be assembled to produce the canopy support illustrated in FIG. 12.

Referring now to FIGS. 10–12, playyard 10 includes a collapsible frame 12, fabric frame cover 14, and removable floor mat 16. A collapsible playyard canopy 80 is provided for covering the top of playyard 10 as shown in FIG. 10. Canopy 80 includes a fabric canopy cover 82, a fabric vent tower 84 coupled to a top portion of canopy cover 82, and a canopy support 86 adapted to be coupled to playyard 10 as shown in FIGS. 10–12 and configured as shown in FIGS. 11, 12, and 16 to support canopy cover 82 and vent tower 84. When not in use, canopy 80 can be collapsed and stored in the collapsed playyard 10 as shown, for example, in FIGS. 18 and 19.

Figure 13:
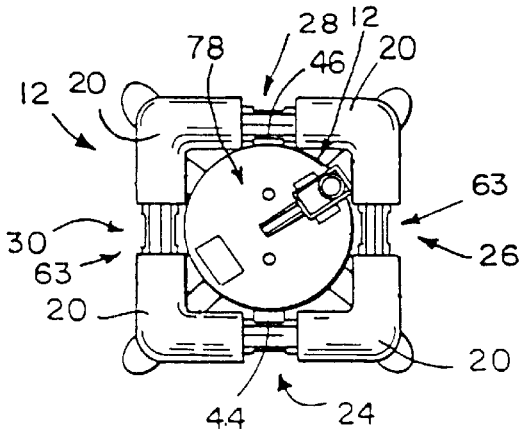
FIG. 13 is a top plan view of the playyard of FIG. 12 after the floor mat has been removed and the playyard frame has been fully collapsed.
Figure 14:
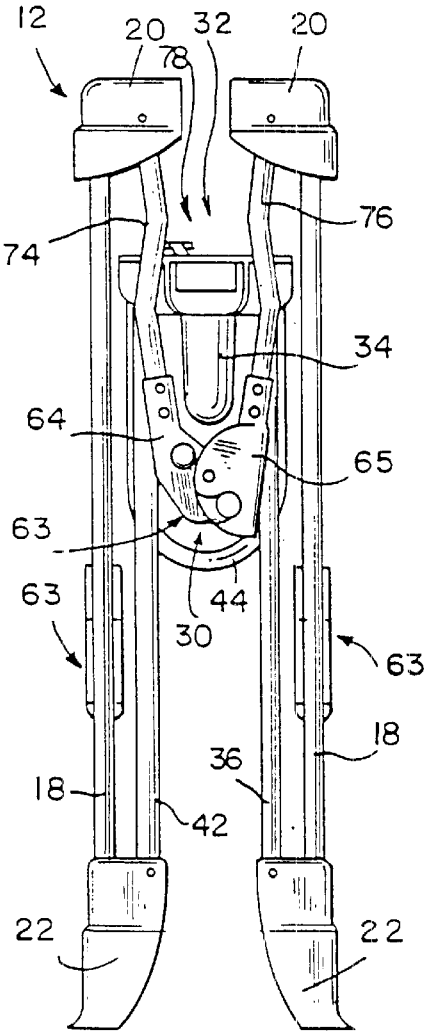
FIG. 14 is a side elevation view of the fully collapsed playyard frame of FIG. 13.
Figure 15:
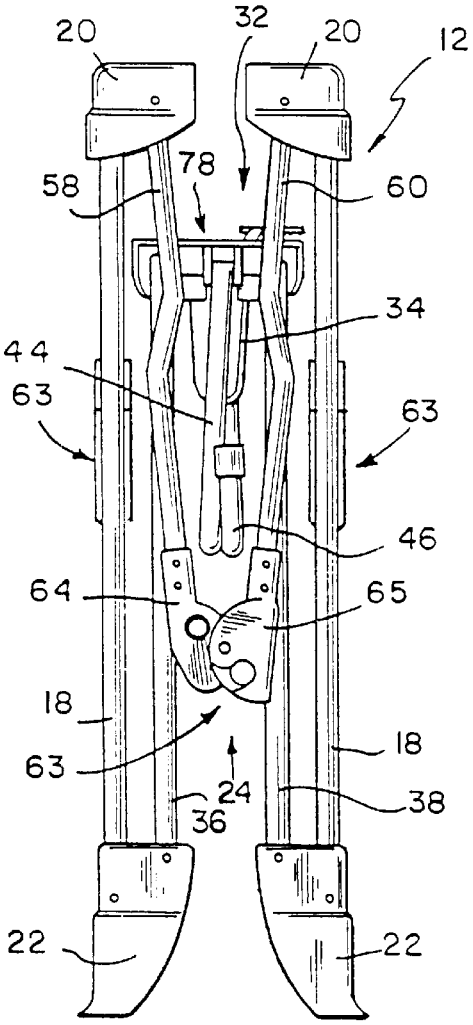
FIG. 15 is an end elevation view of the fully collapsed playyard frame of FIG. 13.

Frame cover 14 is made of sturdy fabric and netting material and is foldable to enable frame 12 to be moved easily from an erected configuration shown in FIGS. 10 and 11 to a collapsed configuration shown in FIGS. 13–15. Floor mat 16 and canopy 80 are removed from frame 12 prior to collapsing frame 12. Once frame 12 is collapsed, the four-segment floor mat 16 can be folded, "wrapped" around collapsed frame 12, and secured using straps (not shown) to provide a "case" for storing and/or carrying collapsed frame 12. Canopy 80 can be collapsed as shown, for example, in FIG. 18 and then stowed in collapsed playyard 10 as shown, for example, in FIG. 19.

As shown, for example, in FIG. 12, canopy support 86 includes a rod connector 88, a leg connector 89, a tower post 90 arranged to interconnect rod and leg connectors 88 and 89, and first, second, third, and fourth support rods 91, 92, 93, and 94. Each one of the support rods has an inner end 95 coupled to rod connector 88 and an outer end 96 adapted to be coupled to one of the playyard corner pieces 20 as suggested in FIG. 12 and shown, for example, in FIG. 11. Support rods 91, 92, 93, and 94 cooperate to support canopy cover 82 above playyard floor 16. Canopy support 86 further includes a tower frame 97 that is coupled to leg connector 89 and support rods 91, 92, 93, 94 and arranged to support vent tower 84 above canopy cover 82. Canopy support 86 is collapsible as shown, for example, in FIGS. 18 and 19 once canopy 80 has been removed from playyard 10 for easy storage in the collapsed playyard 10 or elsewhere. It is within the scope of this disclosure to make the outer diameter of rod connector 88 equal to or less than the outer diameter of leg connector 89.

Collapsible frame 12 includes four corner legs 18, a corner piece 20 at the top end of each corner leg 18, and a corner foot 22 at the bottom end of each corner leg 18. Frame 12 also includes a foldable top rail 24, 26, 28, or 30 interconnecting each pair of adjacent corner pieces 20. Frame 12 further includes a rail mount 32, a foot 34 for elevating rail mount 32, and a support rail 36, 38, 40, or 42 interconnecting rail mount 32 and each of the corner feet 22. Frame 12 also includes two auxiliary support rails 44, 46 coupled to rail mount 32.

Floor mat 16 includes four sections 47, 48, 49, and 50 arranged in series as shown in FIG. 12. Section 47 is coupled to section 48 at fold line 51, section 48 is coupled to section 49 at fold line 52, and section 49 is coupled to section 50 at fold line 53. Floor mat 16 can be "unrolled" to assume a flat configuration and then dropped in place as shown in FIG. 12 to provide a sturdy playyard floor supported in an elevated position above the ground 54 underlying playyard 10 by rail mount 32 and support rails 36, 38, 40, 42, 44, and 46.

Each of support rails 36, 38, 40, and 42 has an outer end pivotably coupled to one of the corner feet 22 and an inner end pivotably coupled to rail mount 32 so as to facilitate collapsing movement of frame 12 from its erected configuration shown in FIGS. 10 and 12 to its collapsed configuration shown in FIGS. 13–15. Each of auxiliary support rails 44 and 46 has an inner end pivotably coupled to rail mount 32 and an outer end formed to define a rail support foot 56 as shown, for example, in FIG. 12. Once assembled, support rails 36, 38, 40, and 42 are arranged to lie in an X-shaped pattern, auxiliary support rail 44 is arranged to bisect the included angle defined by support rails 36 and 38, and auxiliary support rail 46 is arranged to bisect the included angle defined by support rails 40 and 42.

Front top rail 24 includes a left rail segment 58 pivotably coupled to one of the corner pieces 20, a right rail segment 60 coupled for pivotable movement relative to left rail segment 58 (in, for example, the manner described below) and to an adjacent corner piece 20, and a releasable segment lock 62 configured and mounted to "lock" the left and right rail segments 58, 60 together in an in-line relation one to another as shown, for example, in FIGS. 10 and 12 upon movement of frame 12 to its erected configuration. Releasable segment lock 62 is mounted in a two-piece lock housing 63 having a left portion 64 rigidly coupled to left rail segment 58 and a right portion 65 rigidly coupled to right rail segment 60 and pivotably coupled to left portion 64.

Releasable segment lock 62 is mounted in a two-piece portion 63 having a left portion 64 rigidly coupled to left rail segment 58 and a right portion 65 rigidly coupled to right rail segment 60 and pivotably coupled to left portion 64. Left rail segment 58 and left portion 64 (of lock housing 63) cooperate to form a left rail of front top rail 24. Right rail segment 60 and right portion 65 (of lock housing 63) cooperate to form a right rail of front top rail 24.

Each of right-side top rail 26, rear top rail 28, and left-side top rail is similar in structure to front top rail 24 in that each includes a two-piece lock housing 63 containing a releasable segment lock 62. Right-side top rail 26 includes a left rail segment 66 pivotably coupled to one of the corner pieces 20 and rigidly coupled to a left portion 64 of a second lock housing 63 and a right rail segment 68 pivotably coupled to an adjacent corner piece 20 and rigidly coupled to a right portion 65 of the second lock housing 63. Rear top rail 28 includes a left rail segment 70 pivotably coupled to one of the corner pieces 20 and rigidly coupled to a left portion 64 of a third lock housing 63 and a right rail segment 72 pivotably coupled to an adjacent corner piece 20 and rigidly coupled to a right portion 65 of the third lock housing 63. Left-side top rail 30 includes a left rail segment 74 pivotably coupled to one of the corner pieces 20 and rigidly coupled to a left portion 64 of a fourth lock housing 63 and a right rail segment 76 pivotably coupled to an adjacent corner piece 20 and rigidly coupled to a right portion 65 of the fourth lock housing 63.

A releasable rail lock apparatus 78 is provided in rail mount 32 and configured to lock certain of the support rails 36, 38, 40, 42 to rail mount 32 when frame 12 is in its erected configuration as shown in FIG. 12. Rail lock apparatus 78 is configured to engage each of support rails 36, 40 and thereby block pivoting movement of the support rails 36, 40 relative to rail mount 32 when frame 12 is in its erected configuration as shown in FIG. 12 so as to prevent collapsing movement of frame 12 to its collapsed configuration. Rail lock apparatus 78 is configured to be releasable so that a user, after first removing floor mat 16 to expose rail mount 32, can manually actuate rail lock apparatus 78 to disengage a locked connection established between rail mount 32 and support rails 36, 40, thereby allowing pivoting movement of the now unlocked support rails 36, 40 relative to rail mount 32 as shown, for example, in FIG. 17 during controlled collapse of frame 12.

Referring now to FIGS. 12 and 18, playyard 10 can be collapsed by removing canopy 80 and floor mat 16, manually actuating releasable rail lock apparatus 78 and then raising rail mount 32 away from ground 54 to collapse support rails 36, 38, 40, 42, 44, 46 partially, and then manually actuating each of the four releasable segment locks 62 to collapse top rails 24, 26, 28, 30 partially. Then frame 12 can be collapsed further to assume a fully collapsed configuration shown, for example, in FIGS. 13–15. Finally, if desired, collapsed canopy 80 can be stowed in collapsed playyard 10 as shown, for example, in FIGS. 18 and 19 and floor mat 16 can be wrapped around collapsed frame 12 and secured using suitable means to provide a storage case or carrying case for collapsed frame 12.

Referring again to FIG. 10, canopy cover 82 includes front ceiling panel 110, right-side ceiling panel 111, rear ceiling panel 112, and left-side ceiling panel 113. Each of the ceiling panels 110–113 has a trapezoidal shape wherein a long base edge is adapted to extend along one of the top rails 24, 26, 28, 30 of playyard 10 when canopy 80 is mounted on playyard 10, a short top edge abuts a lower edge of vent tower 84, and diagonal edges extend along support rods 91–94 and form boundaries between pairs of adjacent ceiling panels 110–113.

A canopy skirt 114 is defined by the lowest edge of the four ceiling panels 110–113 as shown in FIGS. 10 and 11 and this skirt 114 includes the long base edge of each of the four ceiling panels 110–113. An elastic band 116 is coupled to each corner portion 118 of canopy skirt as shown in FIGS. 10 and 11. Canopy skirt 114 and elastic bands 116 cooperate to help retain canopy 80 in a mounted position on playyard 10 as shown in FIG. 11 once canopy skirt 114 and elastic bands 116 have been pulled down in directions 117 over playyard corner pieces 20 and playyard top rails 24, 26, 28, 30 as suggested in FIG. 10.

When mounted on playyard 10, the outer end 26 of each canopy support rod 91–94 is arranged to engage one of the playyard corner pieces 20 as suggested in FIGS. 10 and 11 to help retain canopy 80 in its mounted position on playyard 10. As shown in FIG. 11, corner piece 20 includes upright walls 118 and 119 and a rod base 120 coupled to upright walls 118, 119 to form an interior corner 112 adapted to receive one of the outer ends 26 of a canopy support rod 91–94 when canopy 80 is mounted on playyard 10. It is within the scope of this disclosure to form each playyard corner piece 20 to include or to provide on or near each playyard corner piece 20 any suitable rod receiver adapted to receive one of the support rod outer ends 26 to assist in mounting canopy 80 on playyard 10.

A rod sleeve 122 is coupled to canopy cover 82 along the boundary between each pair of adjacent ceiling panels and sized to receive one of the canopy support rods 91–94 therein to couple canopy cover 82 to canopy support 86. As shown, for example, in FIG. 11, a rod sleeve 122 is provided along the boundary between rear ceiling panel 112 and left-side ceiling panel 113 to receive fourth rod support 94 therein. Rod sleeve 122 is sized to permit a rod support to slide therein during installation and removal of canopy 80 on and from playyard 10. It is within the scope of this disclosure to use any suitable clip, tie-down, ring, channel, or other connector to couple rod supports 91–94 to canopy cover 82.

Canopy cover 82 is configured to be opened to permit a child caregiver to gain access into playyard 10 when canopy 80 is mounted on top of playyard 10. A zipper connector 122 is provided to join adjacent flaps 124, 126 included in front ceiling panel 110 of canopy cover 82. It is within the scope of this disclosure to provide one or more zipper or other connectors to join flaps included in one or more of the canopy ceiling panels 91–94.

Components included in canopy support 86 are shown, for example, in FIG. 16. Tower frame 97 includes four side legs 127, 128, 129, 130 and four top legs 131, 132, 133, 134. The lower end of each side leg 127–130 is pivotably coupled to one of support rods 91–94 using a pivot pin 135 and an outer end of each top leg 131–134 is pivotably coupled to an upper end of each side leg 127–130 using a pivot pin 136. Vent tower 84 includes a fabric tower ceiling 166 and four mesh tower side walls 168. The lower edges of tower side walls 168 are coupled to canopy cover 82 as shown, for example, in FIG. 10 and can be detachable from canopy cover 82.

Rod connector 88 in canopy support 86 includes a connector ring 137 adapted to pass through apertures 138 formed in inner ends 95 of each support rod 91–94 as suggested in FIG. 16. Rod connector 88 further includes a base plate 139 and a top plate 140 adapted to be coupled to base plate 139 using bolts 141 to support inner ends 95 of support rods 91–94 for pivotable movement about portions of connector ring 137 in between base and top plates 139, 140. A bottom portion 142 of tower post 90 is coupled to a top surface of top plate 140.

Leg connector 89 in canopy support 86 includes a connector ring 143 adapted to pass through apertures 144 formed in inner ends 145 of each top leg 131–134 as suggested in FIG. 16. Leg connector 89 further includes a base plate 146 and a top plate 147 adapted to be coupled to base plate 146 using bolts 141 to support inner ends 145 of top legs 131–134 for pivotable movement about portions of connector ring 143 in between base and top plates 146, 147. A top portion 148 of tower post 90 is coupled to a bottom surface of bottom plate 146 and coupled to bottom portion 142 using a connector 149 to form tower post 90.

Figure 17:
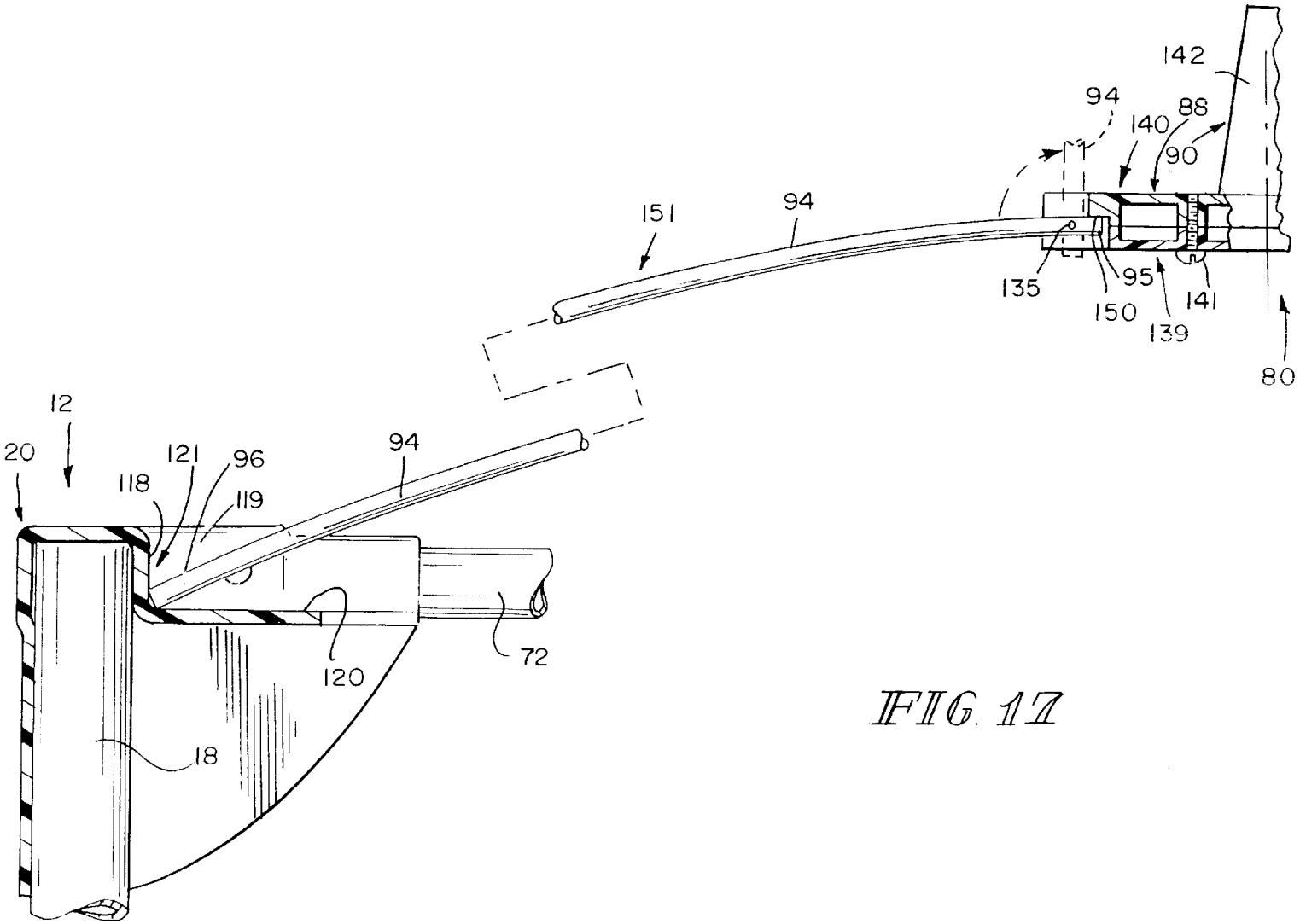
FIG. 17 is a sectional view through the left-side corner of the playyard and the canopy support of FIG. 10 showing contact of an outer end of the third support rod against the third playyard corner piece and contact of an inner end of the third support rod against a downwardly facing lip provided in the rod connector of the canopy support.

Canopy 80 is installed on playyard 10 by pivoting support rods 91–94 in canopy support 86 to the positions shown in FIGS. 12 and 17. The inner end 95 of each support rod 91–94 engages a downwardly facing lip 150 provided in rod connector 88 (see lip 150 in FIG. 8) and each support rod 91–94 is "bowed" in direction 151 so that the outer end 96 of each support rod 91–94 is "captured" in the interior corner 121 provided at playyard corner piece 20 as shown in FIG. 17. Lip 150 restrains counterclockwise rotation of the inner end 95 of support rod 94 (as seen in FIG. 17) to allow bowing of the support rod 94 against the rod connector 88; however, clockwise rotation of support rod 94 about pivot 135 to the dotted line position shown in FIG. 17 is allowed during collapse of canopy 80 to the compact storage position.

Once installed, canopy support 86 maintains canopy cover 82 in a position overlying playyard 10 as shown in FIG. 10. Bending of the support rods 91–94 causes canopy support 86 to be held in place by increased force friction between support rods 91–94 and playyard corner pieces 20. Elastic bands 116 on canopy skirt 114 also help to hold canopy 80 in place on playyard 10.

Figure 19:
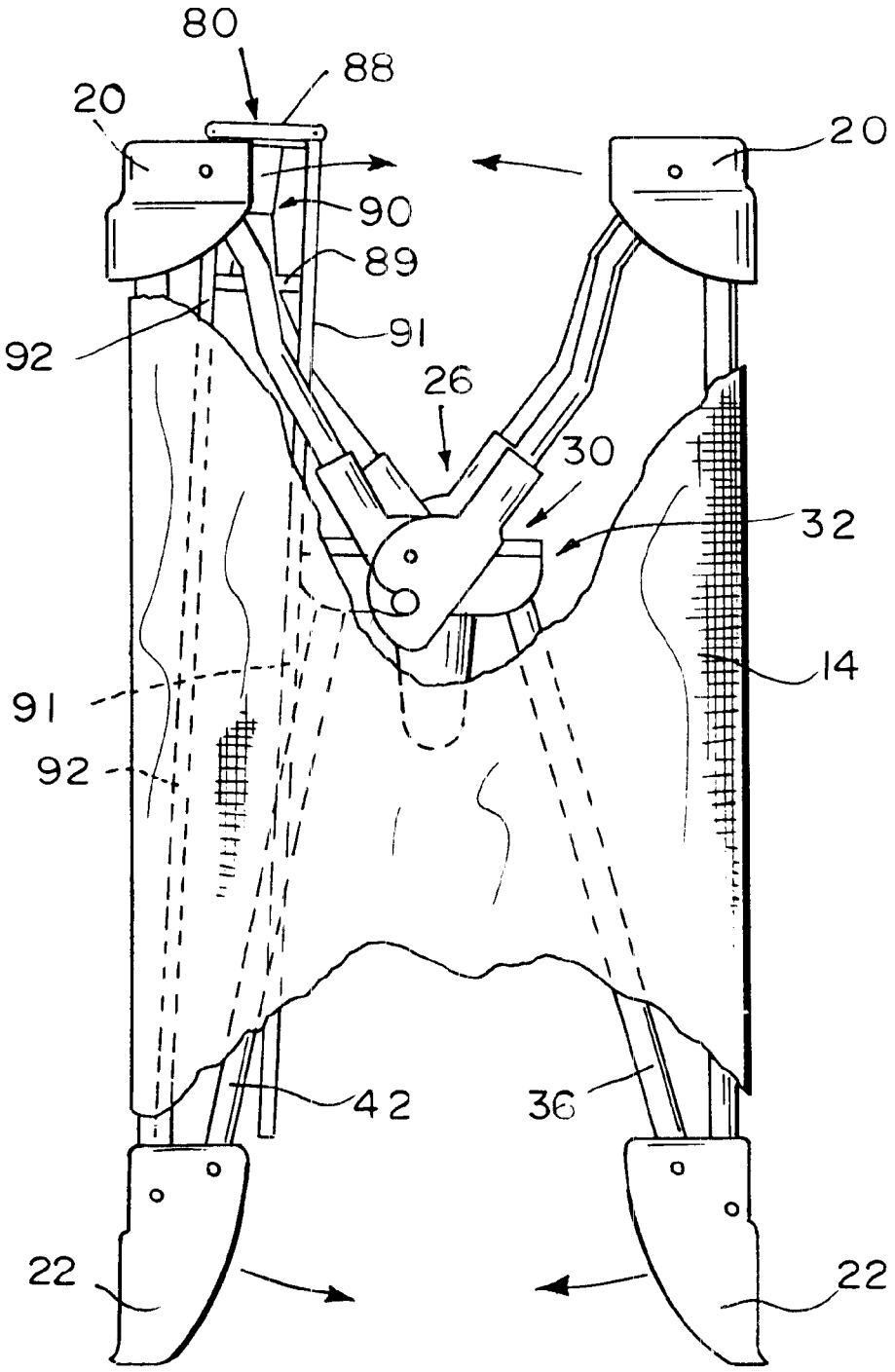
FIG. 19 is a view similar to FIG. 17 showing the position of the fully collapsed playyard canopy after it has been stored in the playyard prior to fully collapsing the playyard to assume the collapsed position shown in FIGS. 13–15.
Figure 21:
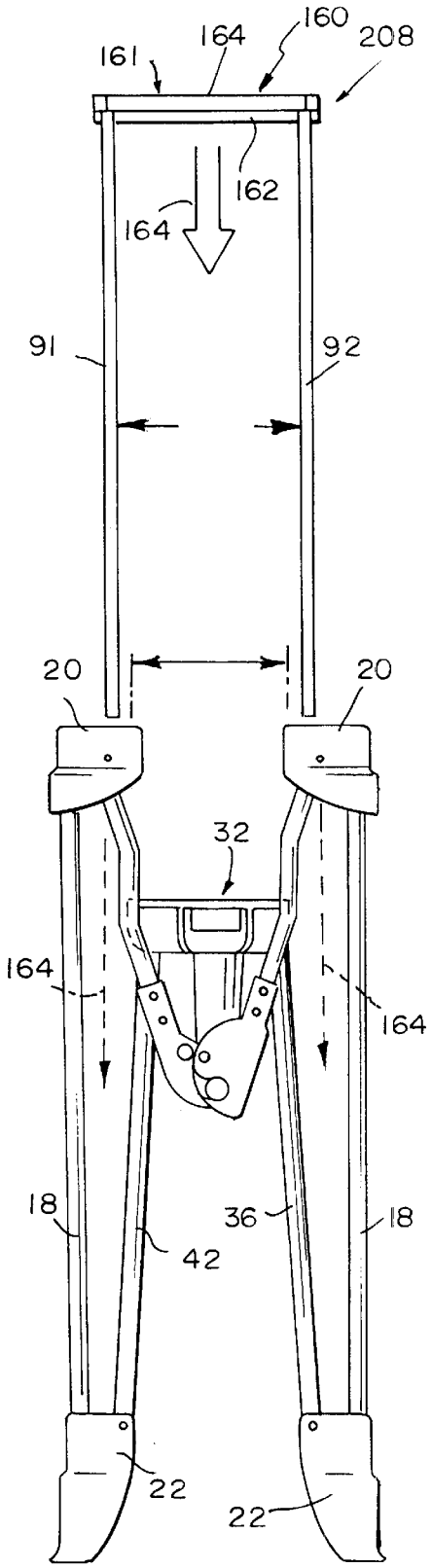
FIG. 21 is a view of a partly collapsed playyard showing insertion of the canopy support of FIG. 20 into an interior space provided in the partly collapsed playyard after complete collapse of the canopy support.
Figure 20:
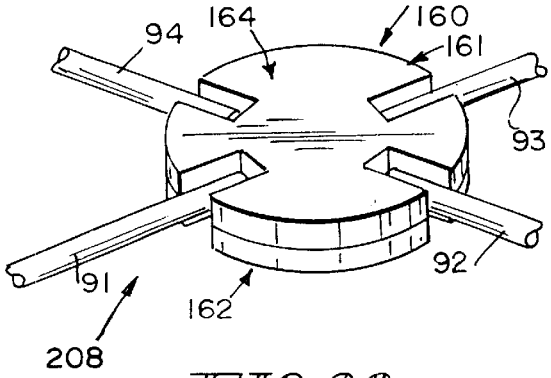
FIG. 20 is a perspective view of another embodiment of a portion of a canopy support including a rod connector and four support rods pivotably coupled to the rod connector suitable for use in the playyard canopy of FIG. 1.

Canopy 80 is removed from playyard 10 by pivoting support rods 91–94 relative to rod connector 88 in directions 152 to assume a partly collapsed configuration as shown in FIG. 18. The canopy 80 is inverted as shown in FIG. 18 and then fully collapsed and inserted into an interior region of the playyard where it assumes a stored position as shown in FIG. 19.

Figure 22:
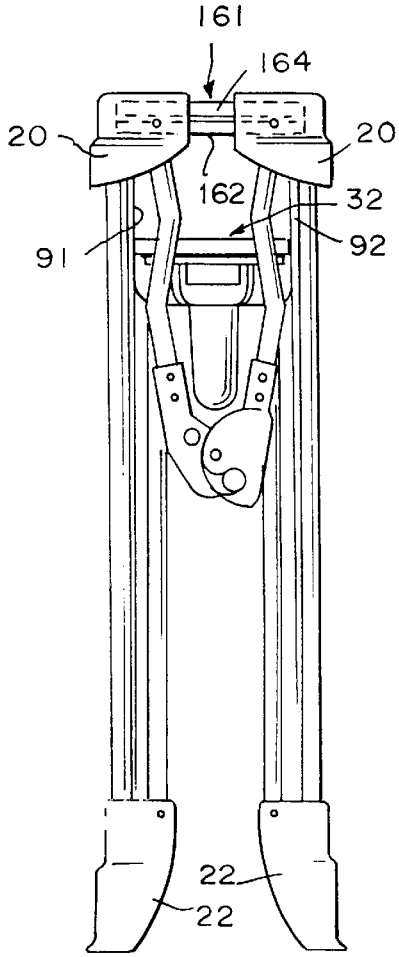
FIG. 22 is a view similar to FIG. 21 showing the canopy support of FIG. 21 in its stored position with the fully collapsed playyard.

Another canopy support 160 is shown in FIGS. 20–23. Canopy support 160 includes support rods 91–94 and a rod connector 161 including a bottom plate 162, a top plate 164 coupled to bottom plate 162, and pivot apparatus (not shown in detail but similar to the pivot apparatus shown in FIG. 16) configured to pivotably couple support rods 91–94 to the rod connector 161. To store canopy support 160 (shown in FIGS. 21 and 22 without a canopy cover thereon) in playyard 10, support rods 91–94 are folded relative to rod connector 161 to assume the configuration shown in FIG. 21. The collapsed canopy support 160 is then lowered in direction 163 into the partly collapsed playyard so that rod connector 161 is positioned to lie above rail mount 32 of playyard and the playyard 10 is then moved to its fully collapsed position as shown in FIG. 22.

Although the invention has been described in detail with reference to certain preferred embodiments, variations and modifications exist within the scope and spirit of the invention as described and defined in the following claims.

What is claimed is:

1. A juvenile playyard comprising a playyard frame, a retainer mount fixed on the playyard frame, a canopy frame support rod, a canopy coupled to the canopy frame support rod and suspended above the playyard frame, and a retainer coupled to the canopy support rod and configured to grip the retainer mount to anchor the canopy frame support rod at a location arranged to lie inside the playyard frame.

2. The playyard of claim 1, wherein the playyard frame includes a frame member and a corner piece coupled to the frame member and the corner piece includes the retainer mount.

3. The playyard of claim 2, wherein the corner piece includes a pair of upright walls and the retainer mount is inclined with respect to the horizontal to lie at an angle to each of the upright walls.

4. The playyard of claim 3, wherein the retainer includes a retainer tip coupled to the canopy frame support rod and a retainer clasp coupled to the retainer tip and arranged to form a channel therebetween and the inclined retainer mount extends into the channel.

5. A juvenile playyard comprising a playyard frame, a retainer mount fixed on the playyard frame, a canopy frame support rod, a canopy coupled to the canopy frame support rod and suspended above the playyard frame, and a retainer coupled to the canopy support rod and configured to grip the retainer mount to anchor the canopy frame support rod to the playyard frame, wherein the retainer includes a retainer tip coupled to the canopy frame support rod and a retainer clasp coupled to the retainer tip and arranged to form a channel receiving a portion of the retainer mount therein and to lie in spaced-apart relation to the playyard frame.

6. A juvenile playyard comprising a playyard frame, a retainer mount fixed on the playyard frame, a canopy frame support rod, and a retainer coupled to the canopy support rod and configured to grip the retainer mount to anchor the canopy frame support rod to the playyard frame, wherein the retainer includes a retainer tip coupled to the canopy frame support rod and a retainer clasp coupled to the retainer tip and arranged to form a channel receiving a portion of the retainer mount therein, and wherein the retainer tip is positioned to lie above a top surface of the retainer mount, the retainer clasp includes a lower arm positioned to lie below a bottom surface of the retainer mount, and further comprising a positioner appended to the bottom surface to engage a grip pad carried on the lower arm to anchor the canopy support frame in a fixed position relative to the playyard frame.

7. The playyard of claim 6, wherein the positioner includes a pair of retainer guides and the grip pad is arranged to lie between the retainer guides.

8. The playyard of claim 6, wherein the positioner includes a pair of spaced-apart retainer guides and a transverse retainer lock bar extending between the retainer guides and the grip pad is arranged to engage the retainer lock bar and lie between the retainer guides.

9. A juvenile playyard comprising a frame having a first top rail and a second top rail defining a plane and a corner, a canopy frame support rod, a retainer mount positioned at the corner, the retainer mount having a top surface and a bottom surface arranged to lie at an angle to the plane, and a retainer coupled to the canopy support rod, the retainer being configured to removably contact the top and bottom surfaces of the retainer mount to anchor the canopy frame support rod in a fixed position relative to the frame.

10. The juvenile playyard of claim 9, further comprising a corner piece coupling the first and second top rails, and wherein the retainer mount is integrally formed with the corner piece.

11. The juvenile playyard of claim 10, wherein the retainer mount includes an apex positioned to lie in a corner of the corner piece and a leading edge positioned to lie opposite to the apex.

12. The juvenile playyard of claim 9, wherein the retainer includes a retainer tip coupled to the canopy frame support rod and a retainer clasp coupled to the retainer tip and to the retainer mount.

13. The juvenile playyard of claim 12, further comprising a positioner coupled to the retainer mount for retaining the retainer clasp in a fixed position relative to the retainer mount.

14. The juvenile playyard of claim 13, wherein the positioner is coupled to the bottom surface of the retainer mount.

15. The juvenile playyard of claim 13, wherein the positioner includes a retainer guide for guiding the position of the retainer clasp during sliding movement of the retainer clasp relative to the retainer mount.

16. The juvenile playyard of claim 13, wherein the positioner includes a retainer lock bar for retaining the retainer clasp in the fixed position.

17. The juvenile playyard of claim 12, wherein the retainer clasp is configured to define a "T"-shaped cross-section.

18. The juvenile playyard of claim 9, wherein the retainer includes a retainer tip receiving an outer end of the canopy frame support rod.

19. The juvenile playyard of claim 18, wherein the retainer tip and the retainer clasp cooperate to define a channel therebetween receiving a portion of the retainer mount therein.

20. A juvenile playyard comprising a frame providing a corner, a canopy frame support rod, a canopy coupled to the canopy frame support rod and suspended above the frame, a retainer mount extending inwardly from an apex of the corner, and a retainer coupled to the canopy frame support rod, the retainer being configured to removably engage the retainer mount for positioning the canopy frame support rod in a fixed position relative to the frame.

21. A juvenile playyard comprising a playyard frame including a corner piece having a pair of upright walls and a rod base coupled to the upright walls to form an interior corner therebetween, a canopy suspended above the playyard frame, and a canopy frame support member coupled to the canopy, the canopy frame support member having an outer end located in the interior corner to retain the canopy frame support member in a fixed space apart position relative to the playyard frame.

* * * * *